US006093314A

United States Patent [19]

Wilson et al.

[11] Patent Number: 6,093,314

[45] Date of Patent: Jul. 25, 2000

[54] DRAIN INSERT FOR STORM WATER SEWER SYSTEMS, AND METHOD OF MANUFACTURE

[76] Inventors: Andrew Charles Wilson, 123 Copeland Road, Beecroft 2119, N.S.W., Australia; Leo J. Yodock, Jr., 750 S. Park Rd., Suite 8-215, Hollywood, Fla. 33021

[21] Appl. No.: 09/092,466

[22] Filed: Jun. 5, 1998

[51] Int. Cl.[7] ..... E03F 5/06; B29C 37/00

[52] U.S. Cl. ..... 210/99; 210/164; 210/166; 210/232; 210/249; 137/247; 264/138

[58] Field of Search ..... 210/99, 111, 163–166, 210/232, 249, 452, 459, 502.1, 908, 909; 248/94; 404/2, 4, 5; 4/290–292; 137/247.33, 247; 264/138

[56] References Cited

U.S. PATENT DOCUMENTS

| | | | |
|---|---|---|---|
| 143,774 | 10/1873 | Moore . | |
| 3,516,541 | 6/1970 | Hardingham . | |
| 3,713,539 | 1/1973 | Thompson et al. . | |
| 3,974,599 | 8/1976 | Grosh . | |
| 4,045,346 | 8/1977 | Swaskey | 210/164 |
| 4,238,333 | 12/1980 | Tidwell | 210/800 |
| 4,460,462 | 7/1984 | Arneson . | |
| 4,922,948 | 5/1990 | Van Dijk . | |
| 5,085,770 | 2/1992 | Eberhardt | 210/242.3 |
| 5,297,367 | 3/1994 | Sainz | 52/12 |
| 5,652,008 | 7/1997 | Heiligman . | |
| 5,733,444 | 3/1998 | Johnson . | |
| 5,788,849 | 8/1998 | Hutter, Jr. et al. . | |

OTHER PUBLICATIONS

Brochure entitled "StreamGuard Nonpoint Source Pullution Control Products" (product: StreamGuard Oil & Grease Catch Basin Insert)—distributed by Foss Entvironment Services of Seattle, Washington (undated).

1997 Environment Solutions Product Guide for Foss Environmental & Infrastructure of Seattle, Washington.

Brochure entitled "Hydro–Cartridges Storm Drain Filtration System"—distributed by Geotechnical Marine Corp. (undated).

*Primary Examiner*—David A. Simmons
*Assistant Examiner*—Fred Prince
*Attorney, Agent, or Firm*—Holland & Knight LLP

[57] ABSTRACT

A drain insert for the drain inlets of storm water sewer systems comprises an outer housing, an inner sleeve integrally formed with and extending within the outer housing, a support hanger carried by the outer housing and adapted to rest atop a concrete flange at the mouth of the drain inlet, and, a collar member which rests atop the concrete flange and at least partially overlies the inner sleeve to direct all run-off water into the interior of the drain insert.

19 Claims, 3 Drawing Sheets

DRAIN INSERT FOR STORM WATER SEWER SYSTEMS, AND METHOD OF MANUFACTURE

FIELD OF THE INVENTION

This invention relates to storm water sewer systems, and, more particularly, to a drain insert for mounting within the drain inlets of a storm water sewer system to prevent sand, stones, gravel and petroleum products from entering into the storm water removal system.

BACKGROUND OF THE INVENTION

Storm water sewer systems are designed for the collection and transport of run-off water from residential and commercial areas to collection basins or repositories such as streams, rivers, lakes, reservoirs and the like. Systems of this type generally comprise a number of drain inlets, typically located along streets, highways, parking facilities and the like, which lead to a network of underground drain lines. These drain lines, in turn, feed the collected run-off water into a particular collection basin.

Unlike sewage systems which deliver waste water to treatment plants, storm water sewer systems transport the run-off water directly to a repository such as a lake, pond or river which often comprises the source of drinking water for nearby communities. Unfortunately, petroleum products such as oil, grease and gasoline, as well as pollutants including heavy metal particles, and, T.C.B. and P.C.B. residues, are carried into the storm water sewer system with the run-off water. In conventional storm water sewer systems, no treatment or removal of these contaminants is provided at any point in the system.

In addition to contaminants such as petroleum products, debris in the form of sand, clay, silt, gravel, stones, small sticks and the like are carried with the run-off water through the drain inlets and into the storm sewer drain pipes of conventional systems. If sufficient debris accumulates within the drain pipes, the volume of run-off water which can be accommodated is correspondingly reduced. In some instances, localized flooding can result in severe rainstorms because the clogged drain lines are unable to carry sufficient volume of run-off water to keep up with the storm.

One solution to the problems outlined above is a removable storm drain cartridge of the type disclosed in U.S. Pat. No. 5,297,367 to Sainz. This "drainage cartridge" is a self-contained unit mounted in the drain inlets of storm water sewer systems for the purposes of collecting debris and petroleum-based pollutants before they can enter the drain pipes. The drain cartridge is a two piece construction including an outer housing, and a separate, inner housing removably mounted within the outer housing. The outer housing has a peripheral lip which is adapted to rest atop a concrete flange formed at the mouth of the drain inlet to support the entire unit therein. Run-off water enters the interior of the unit, flows through the inner housing and then exits the unit through outlet openings formed near the top of the outer housing. In the course of passage through the inner and outer housings, debris such as sand, stones, gravel or the like settles onto the bottom of the outer housing so that it is not carried to the drain pipes below. Additionally, a filter element is mounted at the mouth of the unit to collect petroleum-based contaminants before they are carried away with the run-off water.

Although the '367 patent provides an improvement to existing storm water sewer systems, its design and construction make it impractical and uneconomical for use on a commercial basis. As noted above, a peripheral lip formed on the outer housing of such unit rests atop a concrete flange at the mouth or entrance of the drain inlets in order to mount the unit in place. It has been found that in many localities the drain inlets to the storm water sewer systems are not uniform in size. This typically results from construction of systems during different time periods, by different contractors, and other factors. In any event, it is not economically feasible to construct a large number of different units of the type disclosed in the '367 patent in order to fit all of the varying sizes of drain inlets which may be encountered in a particular locality.

In addition to non-uniformity in dimension, the drain inlets of storm water sewer systems very often have a concrete flange which is uneven along its top surface. Consequently, gaps are formed between the top surface of the concrete flange and the bottom surface of the peripheral lip on the outer housing of the '367 device. Moreover, a peripheral space is nearly always present between the peripheral edge of the lip of the outer housing and the concrete flange due to loose tolerances therebetween which are necessary in order to allow the units to fit within the drain inlets. These gaps and peripheral spaces formed between the unit and the concrete flange provide flow paths, particularly for lower flow rate runoff, directly into the storm water sewer pipes instead of through the unit. As a result, an appreciable amount of runoff may not be filtered, or the debris collected therefrom, with the unit disclosed in the '367 patent.

Another disadvantage of the '367 unit involves its failure to allow for overflow of runoff into the storm water sewer system. As noted above, the peripheral lip on the outer housing of the '367 unit rests directly on the concrete flange at the mouth of the drain inlet. No space or opening of any kind is provided from the mouth of the drain inlet, past the unit to the drain pipes of the storm water sewer system. This can create a serious overflow problem in the adjacent streets, parking areas and the like when the unit becomes blocked or obstructed by debris accumulated within the unit; obstructions at the entrance to the unit such as bags, dead animals and the like; and/or freezing of the water inside of the unit in northern climates. In any of these situations, runoff is prevented from flowing past the unit in the '367 patent and directly into the storm water drain pipes. Instead, the runoff pools at the entrance to the drain inlet and beyond, creating a potentially hazardous situation for motorists, pedestrians and others.

A still further limitation of the '367 device is that it is fabricated in two pieces, including an outer housing and inner housing as noted above. The provision of dyes, molds or other fabricating equipment to make two individual housing sections adds substantial expense to the overall cost of the drainage cartridge. In fact, each unit must be made by hand, and comparatively high-priced materials are employed such as glass reinforced polyester. Additionally, this construction is more difficult to fabricate since tolerances must be met in order for the two housing sections to fit properly together, and within the drain inlets of the storm water sewer system.

SUMMARY OF THE INVENTION

It is therefore among the objectives of this invention to provide a drain insert for the inlets of storm water sewer systems which is economical and comparatively easy to manufacture, which is capable of accommodating a number of drain inlets of different size, and, which is effective to remove debris and petroleum-based contaminants from run-off water entering the storm sewer system through the drain inlet.

These objectives are accomplished in a drain insert for the drain inlets of storm water sewer systems which comprises an outer housing, an inner sleeve integrally formed with and extending within the outer housing, a support hanger carried by a recess in the outer housing and adapted to rest atop a concrete flange at the mouth of the drain inlet, and, a collar member which extends between the grating of the drain insert and the concrete flange to direct all run-off water into the interior of the insert.

One important aspect of this invention is predicated upon the concept of providing a drain insert which can be utilized with drain inlets of varying dimension, thus avoiding the requirement of maintaining a large inventory of units of different dimensions. This flexibility and versatility in the design of the present invention is provided by the support hangers and collar member mentioned above. The one-piece outer housing and inner sleeve construction has an open top end or mouth whose peripheral dimensions may be several inches less than the dimensions of the opening defined by the drain inlet of the storm water sewer system. Unlike the cartridge in U.S. Pat. No. 5,397,367 described above, neither the outer housing nor inner sleeve of the invention mount directly to the concrete flange or other support structure at the entrance of the drain inlet of the storm sewer system. Instead, a pair of support hangers mount at one end within recesses formed in the end walls of the outer housing of the drain insert herein, and the opposite ends of such support hangers rest atop the concrete flange at the entrance to the drain inlet. The support hangers are formed of inexpensive sheet metal or similar material, and can be varied in size to accommodate different drain inlet sizes.

In the presently preferred embodiment, the hangers are dimensioned to suspend the drain insert below the plane of the concrete flange of the drain inlet so that a gap on the order of about two inches is formed between the top edge of the outer housing and the concrete flange. This gap provides a flow path for runoff which bypasses the interior of the drain insert and leads directly into the storm water sewer pipes. Such a bypass or overflow path may be necessary in the event the drain insert becomes clogged or obstructed with debris, dead animals, etc., or, the water within the interior of the drain insert freezes.

In order to prevent run-off water entering the drain inlet from passing along the outside of the drain insert herein, a collar is positioned at the entrance to the drain inlet, extending radially inwardly from the concrete flange of the drain inlet in a direction toward the center of the open top end of the drain insert. The collar acts essentially as a drip edge to direct run-off water into the interior of the drain insert and prevent any spillage along its sides. In the presently preferred embodiment, the collar is formed of an inexpensive plastic or composite material, so that a number of collars in a variety of sizes can be maintained in an inventory to accommodate essentially any drain inlet.

Another important aspect of this invention involves the onepiece construction of the outer housing and inner sleeve. In the presently preferred embodiment, the outer housing includes a continuous outer wall having opposed sidewalls and opposed end walls which are connected at one end to a closed bottom and open at the other end to form a hollow interior. The inner sleeve is defined by an inner wall which is integrally connected to the outer wall near the open top of the outer housing and extends into the hollow interior of the outer housing. The inner wall of the inner sleeve is spaced from the outer wall of the outer housing to form a channel therebetween, and terminates at a location above the closed bottom of the outer housing.

In accordance with the method of forming the drain insert of this invention, the outer housing and inner sleeve described above are formed in a one-piece unit by a rotational molding operation employing linear low density polyethylene or a similar material. The initial structure produced in the rotational molding operation includes an outer housing with a continuous outer wall and an inner sleeve whose inner wall is open at one end and closed by a bottom wall at the opposite end. In subsequent fabricating operations, the bottom wall of the inner sleeve is removed such as by sawing or the like, and elongated outlet openings are formed at least in two areas in the outer wall of the outer housing. The molding operation is fast, economical and produces a commercially acceptable, composite structure which is rugged in construction and extremely durable. The subsequent steps of removing the bottom wall of the inner sleeve and forming outlet openings in the outer housing can be accomplished with unskilled labor at comparatively low cost.

Once in position within the drain inlet of the storm water sewer system, the drain insert of this invention receives all of the run-off water entering the storm sewer system. The entire interior of the drain insert is filled with water, up to the level of the outlet openings in the outer wall of the outer housing, with a filter element carried by the inner sleeve resting on the surface of the water near the top of the drain insert. During a rainstorm or similar event, the run-off water entering the drain inlet of the storm sewer system is directed by the collar into the interior of the drain insert. Water residing in the drain insert is forced through the outlet openings in the outer housing in an amount equal to the volume of run-off water entering the drain inlet. Petroleum-based products such as oil and grease tend to float on the surface of the run-off water and are absorbed by the filter element before they can travel through the inner sleeve and out the outlet openings in the outer housing. Debris such as sand, gravel, stones and the like which are carried with the run-off water into the drain inlet pass through the inner sleeve and tend to settle at the bottom wall of the outer housing. Periodically, the entire drain insert is removed to empty the outer housing of any debris which has collected along its bottom wall, and to replace the filter element with a new one.

BRIEF DESCRIPTION OF THE DRAWINGS

The structure, operation and advantages of the presently preferred embodiment of this invention will become further apparent upon consideration of the following description taken in conjunction with the accompanying drawing wherein.

DETAILED DESCRIPTION OF THE INVENTION

Figure 1:
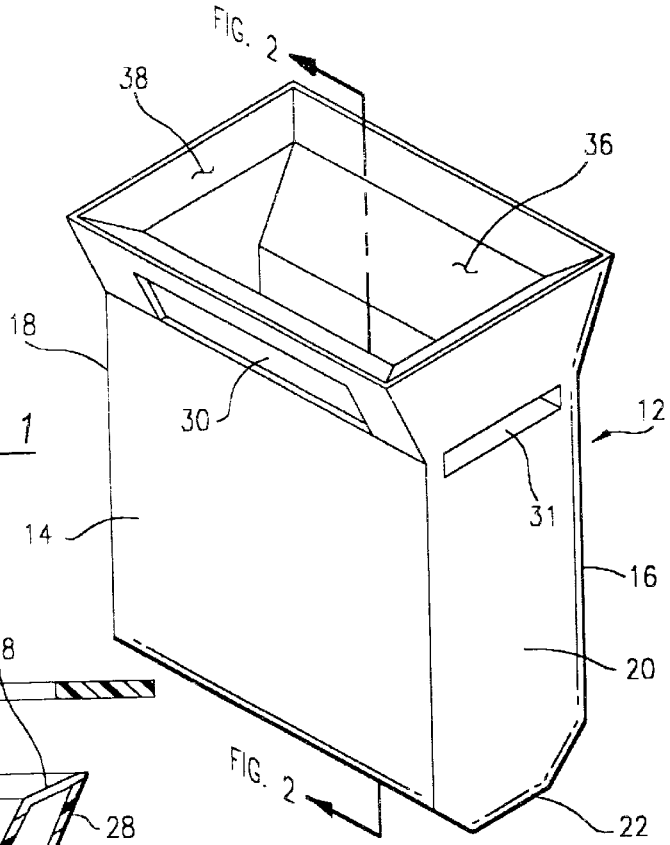
FIG. 1 is a perspective view of the drain insert of this invention.
Figure 2:
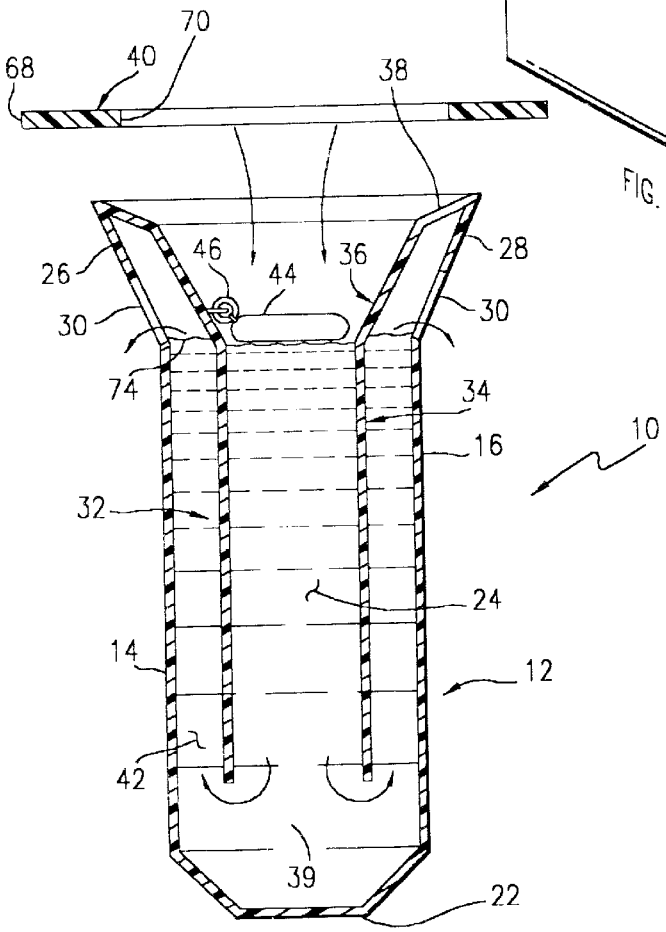
FIG. 2 is a cross-sectional view taken generally along line 2—2 of FIG. 1.
Figure 3:
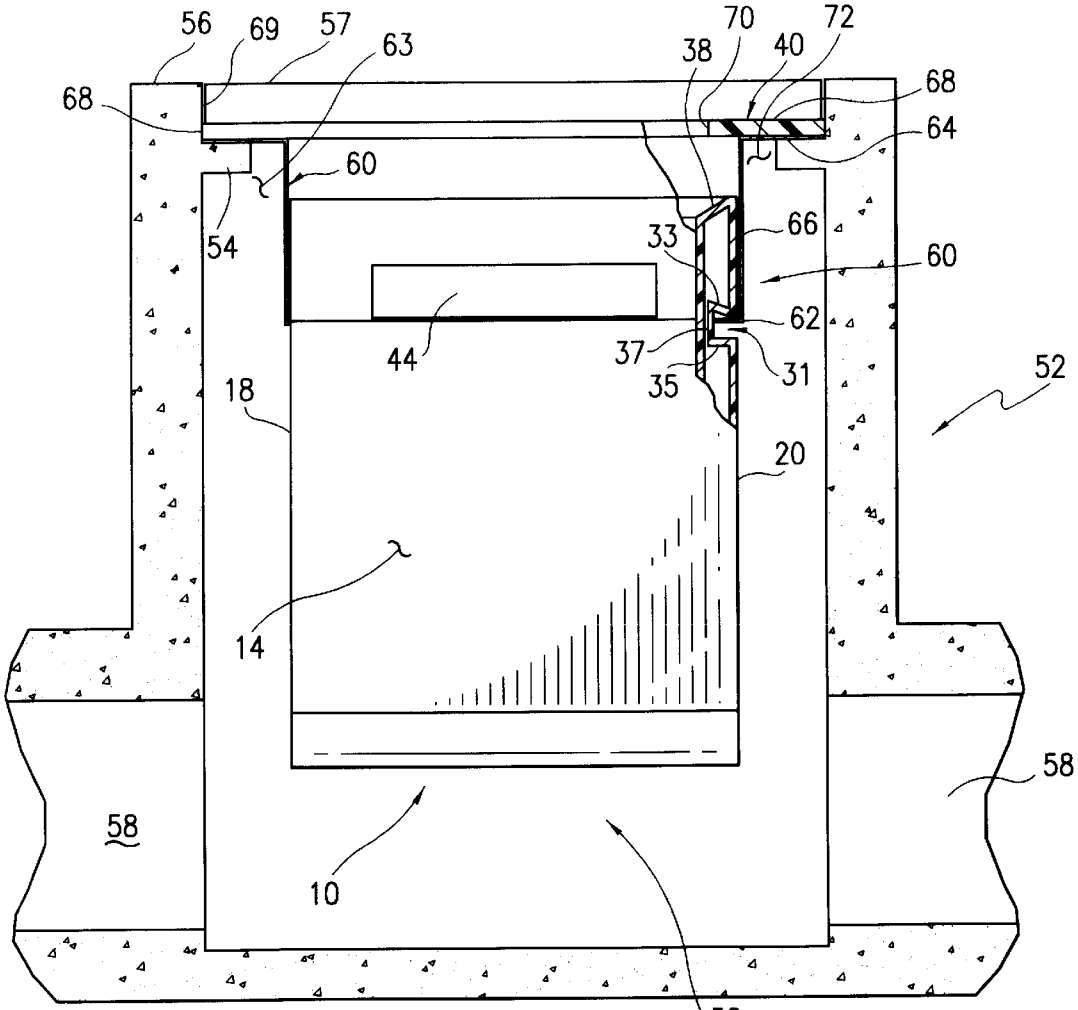
FIG. 3 is a elevational view in partial cross-section of the drain insert positioned at the drain inlet of a storm water sewer system.

Referring now to FIGS. 1 and 2, the drain insert 10 of this invention is depicted. The drain insert 10 comprises an outer housing 12 having opposed sidewalls 14, 16, opposed end walls 18, 20, and a bottom wall 22 which collectively define a hollow interior 24. In the presently preferred embodiment, the sidewalls 14, 16 have an angled upper end 26, 28, respectively, each of which is formed with at least one outlet opening 30. Each of the end walls 18 and 20 is integrally formed with an elongated recess 31, as best seen in FIGS. 1 and 3. Each recess 31, in turn, is generally rectangular in shape including opposed top and bottom edges 33, 35, respectively, connected by a side edge 37.

For purposes of the present discussion, the terms "upper" or "top" refer to the vertical orientation of the drain insert 10 as depicted in FIGS. 1 and 2, and the terms "lower" and "bottom" refer to the opposite direction. The terms "inner" and "outer" refer to the inside and outside areas of the insert 10, respectively, as depicted in FIG. 2.

As discussed in more detail below in connection with a description of FIGS. 5–7, an inner sleeve 32 is intregally formed with the outer housing 12 and extends within its hollow interior 24. The inner sleeve 32 comprises a generally rectangular-shaped, inner wall 34 having an open upper end 36 and an open bottom 39. The upper end 36 is connected to and intregally formed with the upper ends 26, 28 of the sidewalls 14, 16, and the upper portion of end walls 18, 20 of the outer housing 12. The top edge of the inner sleeve 32 forms an angled rim 38 against which a collar 40 is seated as described in more detail below. Preferably, the inner sleeve 32 is positioned within the hollow interior 24 of outer housing 12 such that its inner wall 34 is spaced from the sidewalls 14, 16 and end walls 18, 20 of the outer housing 12 forming a channel 42 therebetween, and such that the open bottom 39 of inner sleeve 32 is located vertically above the bottom wall 22 of outer housing 12.

Figure 4:
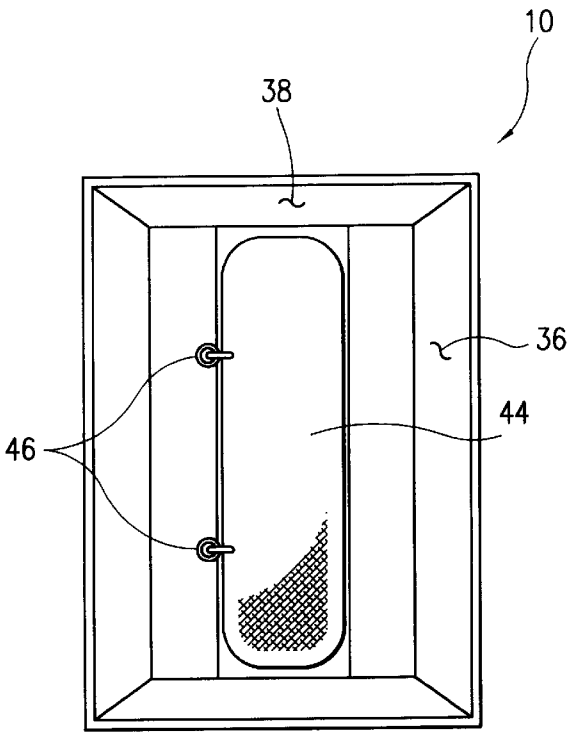
FIG. 4 is a plan view of the drain insert of FIG. 1.

In the presently preferred embodiment, a filter 44 is supported by a pair of hooks 46 extending from the upper end 36 of inner sleeve 32 in position near the top of inner sleeve 32. The filter 44 is formed of a geotextile fabric capable of absorbing petroleum-based products such as gasoline, oil, grease and the like. One type of filter suitable for this purpose is sold under the name and mark "STREAMGUARD" by Foss Environmental & Infrastructure of Seattle, Wash. See also FIG. 4.

Method of Manufacture

Figure 5:
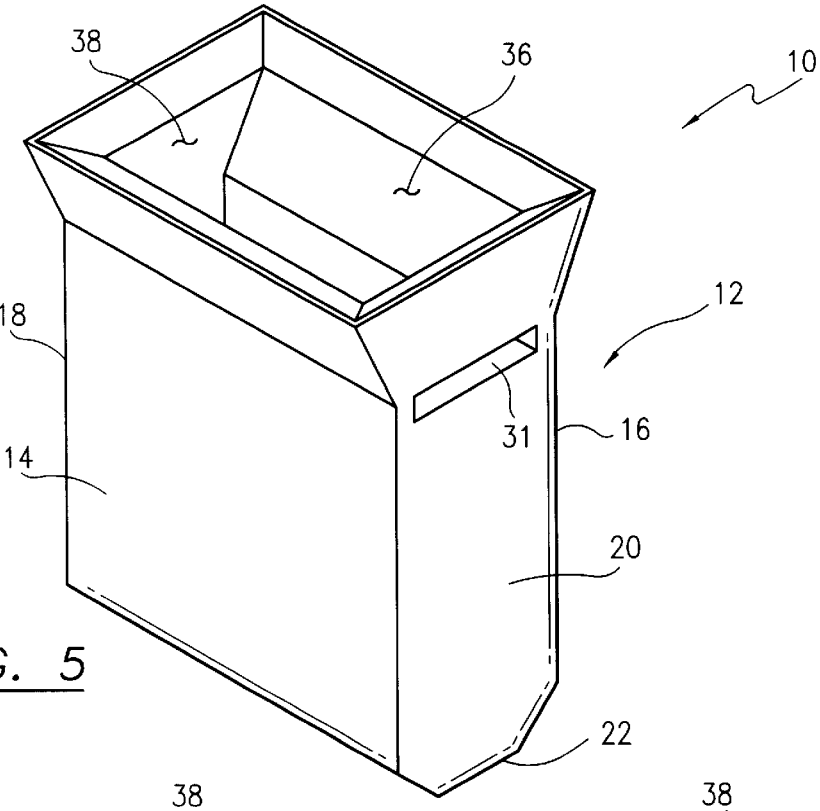
FIG. 5 is a perspective view of the drain insert as initially fabricated in a molding operation.
Figure 6:
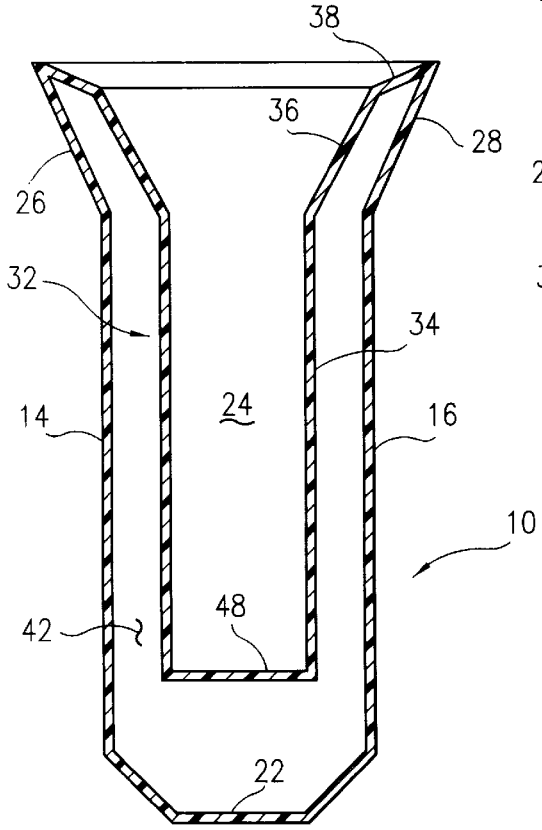
FIG. 6 is a cross-sectional view taken generally along line 6—6 of FIG. 5.
Figure 7:
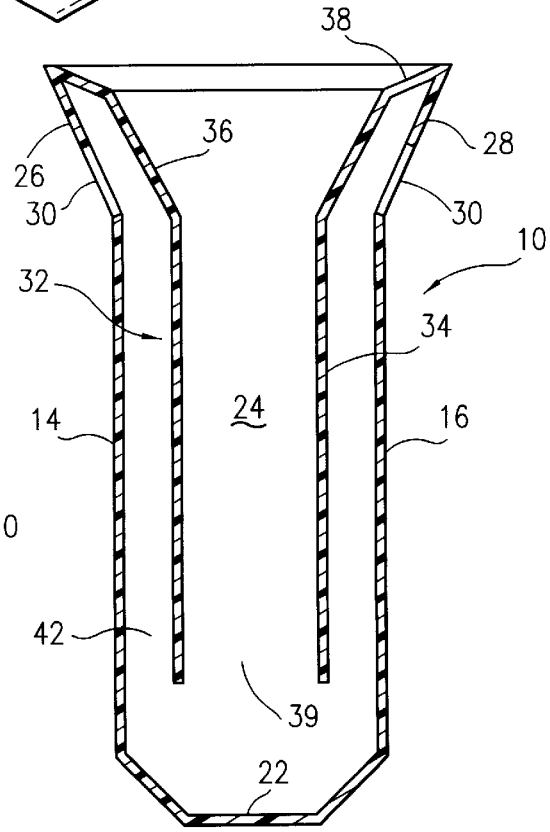
FIG. 7 is a view similar to FIG. 6 except depicting further processing steps to form the finished drain insert.

With reference to FIGS. 5–7, the method of manufacturing the drain insert 10 is schematically depicted. An important aspect of this invention is that the drain insert 10 can be intregally formed in a one-piece construction by conventional rotational molding techniques using a linear lower density polyethylene or a similar material. The details of the actual rotational molding operation form no part of this invention and are thus not described herein.

As discussed above, the rotational molding process results in the formation of the outer housing 12 having a hollow interior 24 within which the inner sleeve 32 is centrally disposed. The outer housing 12 and inner sleeve 32 are intregally connected or formed together at their uppermost ends, i.e., along the upper ends 26, 28 of the sidewalls 14, 16, the upper portion of end walls 18, 20, and, the rim 38 of inner sleeve 32.

The initial structure formed in the molding operation is depicted in FIGS. 5 and 6. The recesses 31 are formed in end walls 18, 20 of outer housing 12, but the inner sleeve 32 is formed with a closed bottom wall 48. In order to form the completed drain insert 10 depicted in FIGS. 2 and 7, subsequent forming operations are undertaken. These include the removal, e.g., by a cutting mechanism or the like, of the closed bottom wall 48 from the inner sleeve 32. Additionally, the outlet openings 30 are formed in sidewalls 14 and 16 in a separate cutting operation. When such cutting operations are completed, the drain insert 10 is ready for use as described in detail below.

Method of Operation

With reference to FIGS. 2 and 3, the operation of drain insert 10 within a typical storm water sewer system is schematically depicted. As shown in FIG. 3, the drain inlet 50 of a storm water sewer system is formed by a concrete casting 52 having a flange 54 near its upper end. The flange 54 is spaced below the top edge 56 of casting 52 so that a grating 57 can be placed atop the flange 54 and substantially flush with the top edge 56 of casting 52 to close the drain inlet 50. One or more drain pipes 58 extend from the drain inlet 50 to the remainder of the storm sewer system (not shown).

As described above, typical storm water sewer systems have a large number of drain inlets 50 each defining an opening having a particular cross sectional area. These openings may vary in size to an appreciable extent within the same storm water sewer system. A problem is thus presented with conventional inserts for storm water sewer drains which are incapable of accommodating differences in dimension of the openings formed by the drain inlets 50.

This problem is overcome in the drain insert 10 of this invention by the provision of support hangers 60, and the collar 40. As best shown in FIG. 3, each support hanger 60 includes a lower end 62, an upper end 64 and an intermediate section 66 therebetween. The support hangers 60 are preferably formed of a rigid material such as sheet metal, composite material, plastic or the like. The lower end 62 of each support hanger 60 is insertable into the recess 31 formed in one of the end walls 18 or 20 and rests against the top edge 33 thereof. The intermediate section 66 extends at a right angle from lower end 62 in an upward direction, along the end wall 18 or 20, to the upper end 64. In turn, the upper end 64 extends at a right angle from the intermediate section 66 and rests atop the flange 54 of concrete casting 52. The entire drain insert 10 is thus supported within the drain inlet 50 by the opposed support hangers 60 connected within the recess 31 of each end wall 18 and 20. The length of each support hanger 60 is such that the top edge of inner sleeve 32 is spaced vertically below the flange 54 of concrete casting 52 thus forming an overflow gap 63 therebetween. Runoff which does not enter the interior 24 of drain insert 10, due to an obstruction, is thus allowed to pass through the overflow gap 63 and directly into the drain pipes 58 of the storm water sewer system.

As depicted in FIG. 3, the upper end 64 of support hanger 60 has sufficient length to extend from the end wall 18 or 20 onto the flange 54 of casting 52 even where the overall width dimension of the drain insert 10, as defined by the width of sidewalls 14, 16, is appreciably less than the width of the drain inlet 50 as defined by the transverse dimension of the flange 54 of concrete casting 52. This permits the drain insert 10 of this invention to be utilized with a variety of drain inlets 50 of different dimension.

It is desirable to funnel or direct all of the run-off water entering the drain inlet 50 into the interior of drain insert 10 during normal operation. In view of the fact that the width of drain insert 10 may be less than the transverse dimension of the drain inlet 50, as described above, the collar 40 is provided. As best seen in FIGS. 2 and 3, the collar 40 is a thin section of material which rests directly atop the support hangers 60 extending from the drain insert 10, and atop the flange 54 of concrete casting 52. The collar 40 has an outer edge 68 having substantially the same circumferential dimensions as the flange 54 of concrete casting 52 to snugly fit against the sidewall 69 of the drain inlet 50. The inner edge 70 of collar 40 extends inwardly from the flange 54, in a direction toward the center of drain insert 10, so that such inner edge 70 lies above at least the angled rim 38 of the inner sleeve 32 of housing 12. The grating 57 is placed atop the collar 40 to secure the collar 40, the support hangers 60, and, in turn, the entire drain insert 10 in place within the drain inlet 50.

The purpose of the collar 40 is to act as a drip edge to direct all run-off water, debris and any other material entering the drain inlet 50 into the interior 24 of drain insert 10. The collar 40 bridges the space or gap 72 between the outer housing 12 of drain insert 10 and the flange 54 of concrete insert 52 to prevent the passage of material therebetween. It is contemplated that a number of collars 40 would be required for a particular storm water sewage system, to account for drain inlets 50 of different size. Alternatively, a collar 40 of one standard dimension could be employed and cut to size on site by the installers. In any event, the collar 40 is formed of an inexpensive plastic, composite material or the like which adds very little cost to the overall installation.

In operation, run-off water and debris such as sand, small stones, gravel and the like are directed by the collar 40 into the interior 24 of the outer housing 12 of drain insert 10. The hollow interior 24 fills up with water to the level of the outlet openings 30 in side walls 14, 16, and that level of water remains within the drain insert 10, essentially at all times, except for evaporation and the like. As additional run-off water enters the drain insert 10, an equal quantity of water is discharged from the hollow interior 24 through the outlet openings 30 where it enters the drain pipes 58 of the storm water sewer system. As depicted by the arrows in FIG. 2, the water entering drain insert 10 must first flow through the interior of inner sleeve 32 and then along the channel 42 between inner sleeve 32 and outer housing 12 before it reaches the outlet openings 30. In the course of such movement through the drain insert 10, debris such as sand, gravel, small stones and the like carried with the run-off water tends to settle along the bottom wall 22 of the drain insert 10. This substantially prevents the discharge of such debris into the storm water sewer system where it would otherwise collect and potentially create problems of clogging and the like. Periodically, the drain insert 10 must be removed from the drain inlet 50 to empty debris from the bottom portion of outer housing 12, as required.

As shown in FIGS. 2 and 3, the filter 44 rests atop the surface 74 of the water within the drain insert 10. The filter 44 is formed of a material capable of absorbing petroleum-based products such as gasoline, oil, grease and the like. Such petroleum products tend to float on the surface 74 of water within the drain insert 10, and the filter 44 is positioned where indicated in the FIGS. to absorb same. It is contemplated that the filter 44 would be replaced periodically when debris is removed from the drain insert 10, as described above.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the insert 10 is depicted in the FIGS. are generally rectangular in shape consistent with the shape of the drain inlet 50. It is contemplated that the insert 10 could be of essentially any cross-sectional configuration, e.g., square, round, oval, etc., depending upon the requirements of a particular application. Additionally, the hangers 60 are illustrated as each having a lower edge 62 insertable within the recess 31 formed in the end walls 18, 20 of outer housing 12. It should be understood that other types of mounting means could be employed to permanently or releasably affix the lower end of hangers 60 to the drain insert 10, such as screws, bolts, rivets, welds, etc.

Therefore, it is intended that the invention not be limited to the particular embodiment disclosed as the best mode contemplated for carrying out this invention, but that the invention will include all embodiments falling within the scope of the appended claims.

What is claimed is:

1. In a storm water sewer system including a drain inlet having a flange which supports a grating, a drain insert comprising:

an outer housing including an outer wall connected at one end to a closed bottom and open at the other end to define a hollow interior, said outer wall being formed with at least one outlet opening and with at least one mounting element;

an inner sleeve formed by an inner wall having first and second ends, said inner sleeve being positioned within said hollow interior of said outer housing such that said first end is connected to said outer wall, said inner wall is spaced from said outer wall and said second end is spaced from said closed bottom of said outer housing;

a filter element mounted within said inner sleeve;

a support member having a first end connected to said mounting element of said outer wall of said outer housing, and a second end adapted to rest atop the flange of the drain inlet and beneath the grating so that said outer housing and said inner sleeve are removably supported within said drain inlet.

2. The drain insert of claim 1 in which said at least one mounting element of said outer housing is at least one recess, said at least one recess including opposed first and second edges connected by a side edge, said first and second edges extending from said outer wall in a direction toward said hollow interior of said outer housing.

3. The drain insert of claim 2 in which said support member is a pair of support hangers each having a first end angled in one direction, a second end angled in the opposite direction and an intermediate section therebetween, said first end of each support hanger being insertable within one of said at least one recess in engagement with said first edge thereof and said second end of each hanger being adapted to rest atop the flange of the drain insert.

4. The drain insert of claim 1 further including a collar member removably positioned atop the flange of the drain inlet and at least partially overlying said first end of said inner sleeve to direct runoff into said hollow interior.

5. In a storm water sewer system including a drain inlet having a flange which supports a grating, a drain insert comprising:

an outer housing including an outer wall connected at one end to a closed bottom and open at the other end to define a hollow interior, said outer wall being formed with at least one outlet opening and with at least one mounting element;

an inner sleeve formed by an inner wall having first and second ends, said inner sleeve being positioned within said hollow interior of said outer housing such that said first end is connected to said outer wall and forms an inlet opening into said hollow interior, said inner wall being spaced from said outer wall and said second end being spaced from said closed bottom of said outer housing;

a filter element mounted within said inner sleeve;

a support member having a first end connected to said mounting element of said outer wall of said outer housing, and a second end adapted to rest atop the flange of the drain inlet and beneath the grating so that said outer housing and said inner sleeve are removably supported within said drain inlet;

a collar member removably positioned atop the flange of the drain inlet and at least partially overlying said first end of said inner sleeve to direct runoff through said inlet opening formed by said first end of said inner sleeve and into said hollow interior of said outer housing.

6. The drain insert of claim 5 in which said at least one mounting element of said outer housing is at least one recess, said at least one recess including opposed first and second edges connected by a side edge, said first and second edges extending from said outer wall in a direction toward said hollow interior of said outer housing.

7. The drain insert of claim 6 in which said support member is a pair of support hangers each having a first end angled outwardly in one direction, a second end angled in the opposite direction and an intermediate section therebetween, said first end of each support hanger being insertable within one of said at least one recess in engagement with said first edge thereof and said second end of each hanger being adapted to rest atop the flange of the drain insert.

8. The drain insert of claim 5 in which said collar member includes an outer edge having substantially the same dimensions as the flange of the drain inlet.

9. The drain insert of claim 8 in which said collar member has an inner edge which at least partially overlies said inlet opening formed by said first end of said inner sleeve.

10. In a storm water sewer system including a drain inlet having a flange which supports a grating, a drain insert comprising:

an integrally formed outer housing and inner sleeve, said outer housing including a continuous outer wall integrally connected to a closed bottom and open at the top to form a hollow interior, said outer wall being formed with at least one outlet opening and with at least one mounting element, said inner sleeve including a continuous inner wall integrally connected along the top of said outer wall and extending into said hollow interior to a location spaced from said closed bottom;

a filter element mounted within said inner sleeve;

a support member having a first end connected to said outer wall of said mounting element of said outer housing, and a second end adapted to rest atop the flange of the drain inlet and beneath the grating so that said outer housing and inner sleeve are removably supported within said drain inlet.

11. The drain insert of claim 10 in which said mounting element of said outer housing is at least one recess, said at least one recess including opposed first and second edges connected by a side edge, said first and second edges extending from said outer wall in a direction toward said hollow interior of said outer housing.

12. The drain insert of claim 11 in which said support member is a pair of support hangers each having a first end angled in one direction, a second end angled in the opposite direction and an intermediate section therebetween said first end of each hanger being insertable within one of said at least one recess in engagement with said first edge thereof and said second end of each hanger being adapted to rest atop the flange of the drain inlet.

13. The drain insert of claim 10 further including a collar member removably positioned atop the flange of the drain inlet and at least partially overlying said first end of said inner sleeve to direct runoff into said hollow interior.

14. A method of forming a drain insert for mounting within drain inlets of a storm water sewer system, comprising:

(a) molding a one-piece unit in the form of an outer housing having a continuous outer sidewall, a closed bottom and an open top, and, an inner sleeve having a continuous inner sidewall integrally connected at the top of said outer sidewall, a closed bottom spaced from said closed bottom of said outer housing and an open top, said inner sidewall tapering inwardly from said open top of said outer housing forming a space between said inner and outer sidewalls;

(b) removing said closed bottom from said inner sleeve;

(c) forming at least one outlet opening in said outer sidewall of said outer housing.

15. The method of claim 14 in which step (a) further includes molding at least one recess into said outer wall of said outer housing.

16. In a storm water sewer system including a drain inlet having a flange which supports a grating, a drain insert comprising:

an outer housing including an outer wall connected at one end to a closed bottom and open at the other end to define a hollow interior, said outer wall being formed with at least one outlet opening and with at least one mounting element;

an inner sleeve formed by an inner wall having a first end and a second end, said inner sleeve being positioned within said hollow interior of said outer housing such that said first end is connected to said outer wall and forms an inlet opening into said hollow interior, said inner wall being spaced from said outer wall and said second end being spaced from said closed bottom of said outer housing;

a filter element mounted within said inner sleeve;

a support member having a first end engageable with said mounting element of said outer wall of said outer housing, and a second end adapted to rest atop the flange of the drain inlet and beneath the grating so that said outer housing and said inner sleeve are removably supported within said drain inlet in a position wherein a space is provided between the flange of the drain inlet and said inlet opening into said hollow interior formed by said first end of said inner sleeve, said space permitting the flow of storm water entering the drain inlet directly into the storm water sewer system in the event said inlet opening becomes clogged.

17. The drain insert of claim 16 in which said at least one mounting element of said outer housing is at least one recess, said at least one recess including opposed first and second edges connected by a side edge, said first and second edges extending from said outer wall in a direction toward said hollow interior of said outer housing.

18. The drain insert of claim 17 in which said support member is a pair of support hangers each having a first end angled in one direction, a second end angled in the opposite direction and an intermediate section therebetween, said first end of each support hanger being insertable within one of said at least one recess in engagement with said first edge thereof and said second end of each hanger being adapted to rest atop the flange of the drain insert.

19. The drain insert of claim 16 further including a collar member removably positioned atop the flange of the drain inlet and at least partially overlying said first end of said inner sleeve to direct runoff into said hollow interior.

* * * * *